United States Patent [19]

Leask

[11] Patent Number: 5,026,069

[45] Date of Patent: Jun. 25, 1991

[54] METHOD OF PLAYING A BATTLE STRATEGY GAME

[76] Inventor: Harald J. Leask, Sumburgh Head Lighthouse, Virkie, Shetland Island, Scotland

[21] Appl. No.: 504,674

[22] Filed: Apr. 4, 1990

[51] Int. Cl.[5] ..... A63F 3/00

[52] U.S. Cl. ..... 273/255; 273/290

[58] Field of Search ..... 273/255, 262, 290, 288

[56] References Cited

U.S. PATENT DOCUMENTS

| | | | |
|---|---|---|---|
| 972,382 | 10/1910 | Johnson-Jervis | 273/262 |
| 1,210,854 | 1/1917 | Schroer | 273/262 |
| 1,281,094 | 10/1918 | Straight | 273/262 |
| 2,277,301 | 3/1942 | Channer | 273/255 |

FOREIGN PATENT DOCUMENTS

| | | | |
|---|---|---|---|
| 7408 | 3/1902 | United Kingdom | 273/262 |

*Primary Examiner*—Benjamin Layno

*Attorney, Agent, or Firm*—Leon Gilden

[57] ABSTRACT

The battle strategy game includes the positioning of a series of 113 figurative combatants on either side of a medial positioned river of a game board. The pieces are allowed to advance and retreat or attack in response to indication by a six-sided dice member. The various combatants are positioned upon category markers to include cavalry, infrantry, artillery, and an officer in charge of each group of combatants.

5 Claims, 3 Drawing Sheets

METHOD OF PLAYING A BATTLE STRATEGY GAME

BACKGROUND OF THE INVENTION

1. Field of the Invention

The field of invention relates to military games, and more particularly pertains to a new and improved battle strategy game wherein the same utilizes the strategy of deploying men and advancing upon opposing position in order to gain advantage thereover.

2. Description of the Prior Art

The use and playing of games in various configurations is well known in the prior art. Examples of the prior include U.S. Pat. No. 4,261,574 to Rogers wherein opposing sides of a checkerboard-type game board utilizes three dice to indicate movement of opposing sides to destroy opposing space ship figurative players.

U.S. Pat. No. 4,779,875 to Sypal utilizes a game board for two or more players with a controlled token movement area to determine movement of the various tokens throughout the game board wherein the various themes may be utilized in the playing of the game.

U.S. Pat. No. 3,913,920 to Brummit provides for a game board divided into a plurality of home ports for opposing navies wherein each side contains a series of grid cells. Levers under the game board connect each grid cell with an intermediate lever such that when two ships of opposing navies are mounted in the openings of adjacent grid cells, the corps attacking ship is oriented to place a completely opened socket nearest the other ship to force the other ship up and out of its grid cell in simulation of blowing the ship out of the water.

U.S. Pat. No. 4,572,514 to Atonte sets forth a military game utilizing various tokens, markers, and chance cards in the controlling of movement of the opposing player armies.

U.S. Pat. No. 4,480,837 to Poirier sets forth the playing of a maritime game with opposing players dodging various hazards, such as mine positions and the like, wherein the game is won by the first ship marker completing a corridor route predetermined upon the game board.

As such, it may be appreciated that there is a continuing need for a new and improved battle strategy game employing the various objects of chance, strategy skills, and forethought to orient opposing armies upon a game board to effect victory upon elimination of an opponent's army, and in this respect, the present invention substantially fulfills this need.

SUMMARY OF THE INVENTION

In view of the foregoing disadvantages inherent in the known types of battle games now present in the prior art, the present invention provides a battle strategy game wherein the same utilizes a multi-colored die to enable advance, retreat, and destroy of opponent armies. As such, the general purpose of the present invention, which will be described subsequently in greater detail, is to provide a method of playing a new game which has all the advantages of the prior art battle games and none of the disadvantages.

To attain this, the present invention includes a battle strategy game providing a game board with a medially positioned with a single bridge fording the river, as well as a river ford orthogonally directed across the river providing access to an opposing player's surface. A plurality of spaced walls on opposite sides of the river provide a movement impediment to the markers of the game to circumvent the wall to enable crossing the river behind the opposing walls to gain access to the opposing side of the game board. A multi-colored die including four sides, three sides of a first coloration to indicate advance, a single side of a second coloration to indicate retreat, and opposing ends of a third coloration to indicate a destroying or killing of two opponent soldiers. Each side is provided with a series of plates supporting a matrix of apertures defining a particular unit of players, such as cavalry, infantry, artillery, or officer, wherein each plate is movably positionable on the game board a predetermined distance about a playing surface free of any predefined path, grid of spaces, or demarcation defining movement. Opposing colored markers, such as red and white, are provided each player, with black markers substituted for the red and white markers to indicate a "kill" of a respective soldier-marker. The plates are initially positioned in an aligned plurality of rows at the outset of the game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the inveniton in any way.

It is therefore an object of the present invention to provide a new and improved battle strategy game which has all the advantages of the prior art battle games and none of the disadvantages.

It is another object of the present invention to provide a new and improved battle strategy game which may be easily and efficiently manufactured and marketed.

It is a further object of the present invention to provide a new and improved battle strategy game which is of a durable and reliable construction.

An even further object of the present invention is to provide a new and improved battle strategy game which is susceptible of a low cost of manufacture with regard to both materials and labor, and which accordingly is then susceptible of low prices of sale to the consuming public, thereby making such battle strategy games economically available to the buying public.

Still yet another object of the present invention is to provide a new and improved battle strategy game which provides in the apparatuses and methods of the prior art some of the advantages thereof, while simultaneously overcoming some of the disadvantages normally associated therewith.

Still another object of the present invention is to provide a new and improved battle strategy game wherein the same enables positioning of markers about the game board for encircling and encountering opposing markers for the purpose of eliminating opposing soldiers of a respective opposing side These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
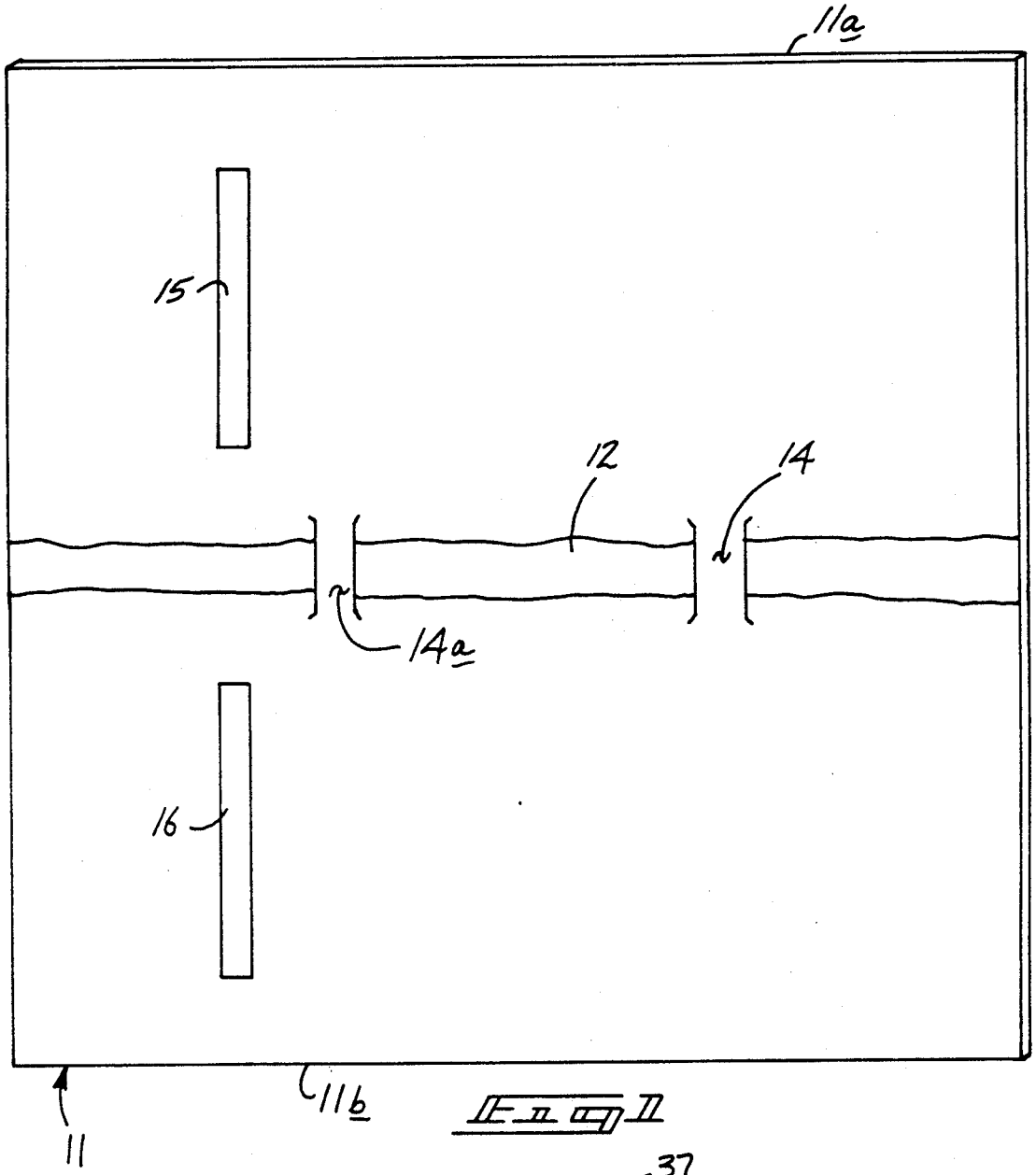
FIG. 1 is a top orthographic view of the game board of the instant invention.
Figure 2:
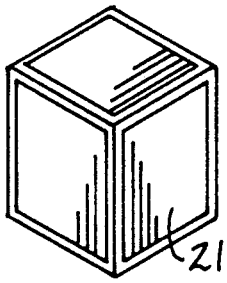
FIG. 2 is an isometric illustration of the officer marker of the instant invention.
Figure 2A:
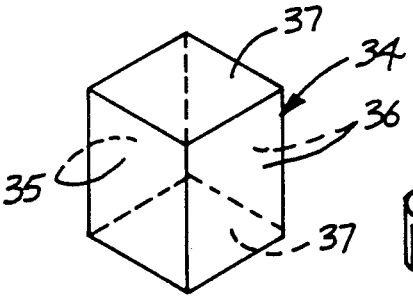
FIG. 2*a* is an isometric illustration of the dice utilized by the instant invention.

With reference now to the drawings, and in particular to FIGS. 1 to 12 thereof, a new and improved battle strategy game embodying the principles and concepts of the present invention and generally designated by the reference numeral 10 will be described.

More specifically, the battle strategy game 10 of the instant invention essentially comprises a medially divided game board 11 having a surface free of any grid of spaces, predefined path, or any demarcation defining movement to define opposing open surfaces 40 and 41 enabling free movement of opposing player tokens, to be discussed in more detail below. The game board includes a top side 11*a* and a bottom side 11*b* to indicate the opposing sides of the two players to participate in the game. A central river 12 spans the complete width of the game board and medially demarcates the playing area of the game board. A bridge 14 and a river crossing ford 14*a* permit river crossing of the river at those portions. The bridge 14 and ford 14*a* are orthogonally directed across the river 12 and are equally spaced relative to one another, as well as to the side of board 11. A top wall 15 and a bottom wall 16 orthogonally oriented between the river 12 and respective top and bottom sides 11*a* and 11*b*and equally spaced from the river and an associated respective side 11*a* and 11*b*. Apertured markers are thereby permitted movement around the respective walls 15 and 16 between an end of respective wall and sides and river of the game board, as illustrated in FIG. 1 for example.

Figure 3:
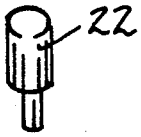
FIG. 3 is an isometric illustration of a typical soldier marker utilized by the instant invention.
Figure 4:
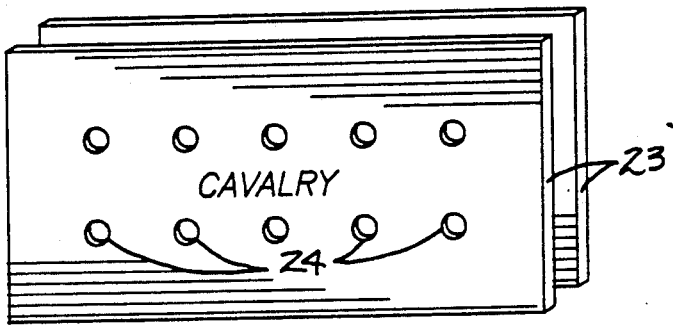
FIG. 4 is an isometric illustration of the cavalry plates utilized by each player in the instant invention.
Figure 11:
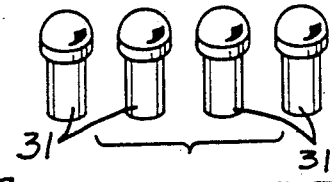
FIG. 11 is an isometric illustration of the kill plates utilized by opposing players in the instant invention.
Figure 10:
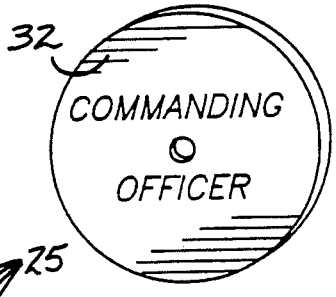
FIG. 10 is an isometric illustration of the officer plates utilized by each opposing player of the instant invention.
Figure 5:
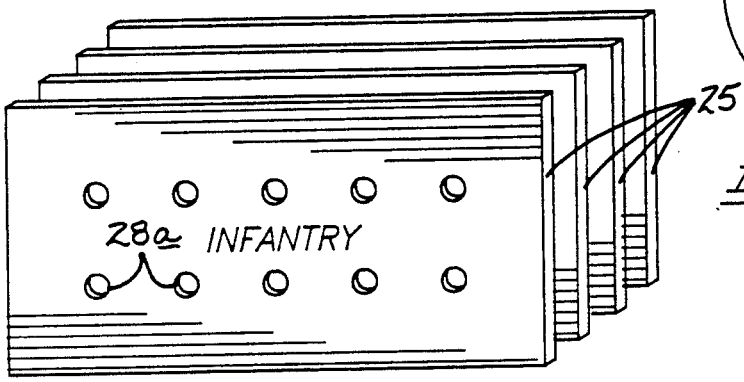
FIGS. 5, 6, 7 and 8 are isometric illustrations of the infantry plates utilized by opposing players of the instant invention.
Figure 6:
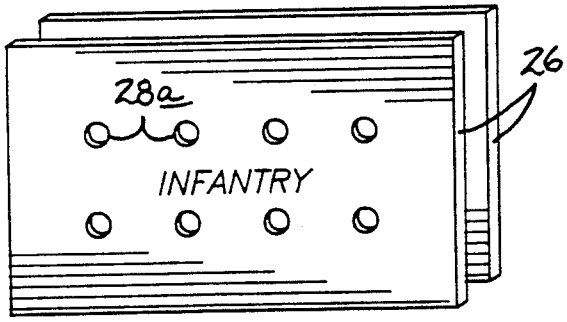
Figure 8:
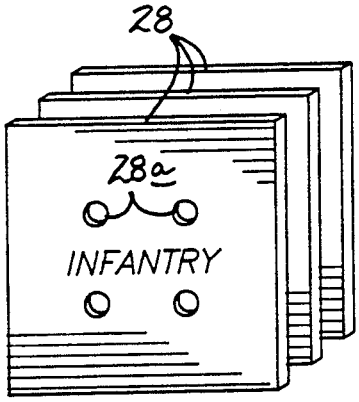
Figure 7:
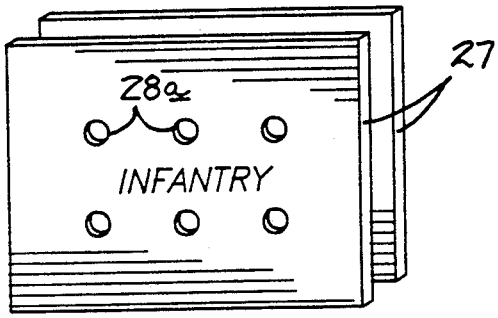
Figure 9:
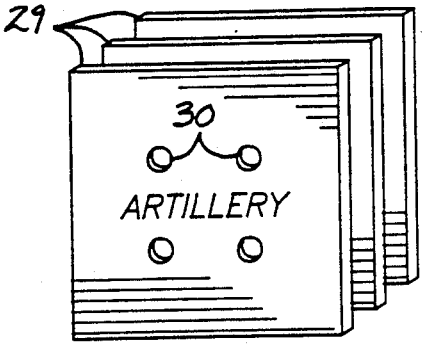
FIG. 9 is an isometric illustration of the artillery plates utilized by opposing players of the instant invention.
Figure 12:
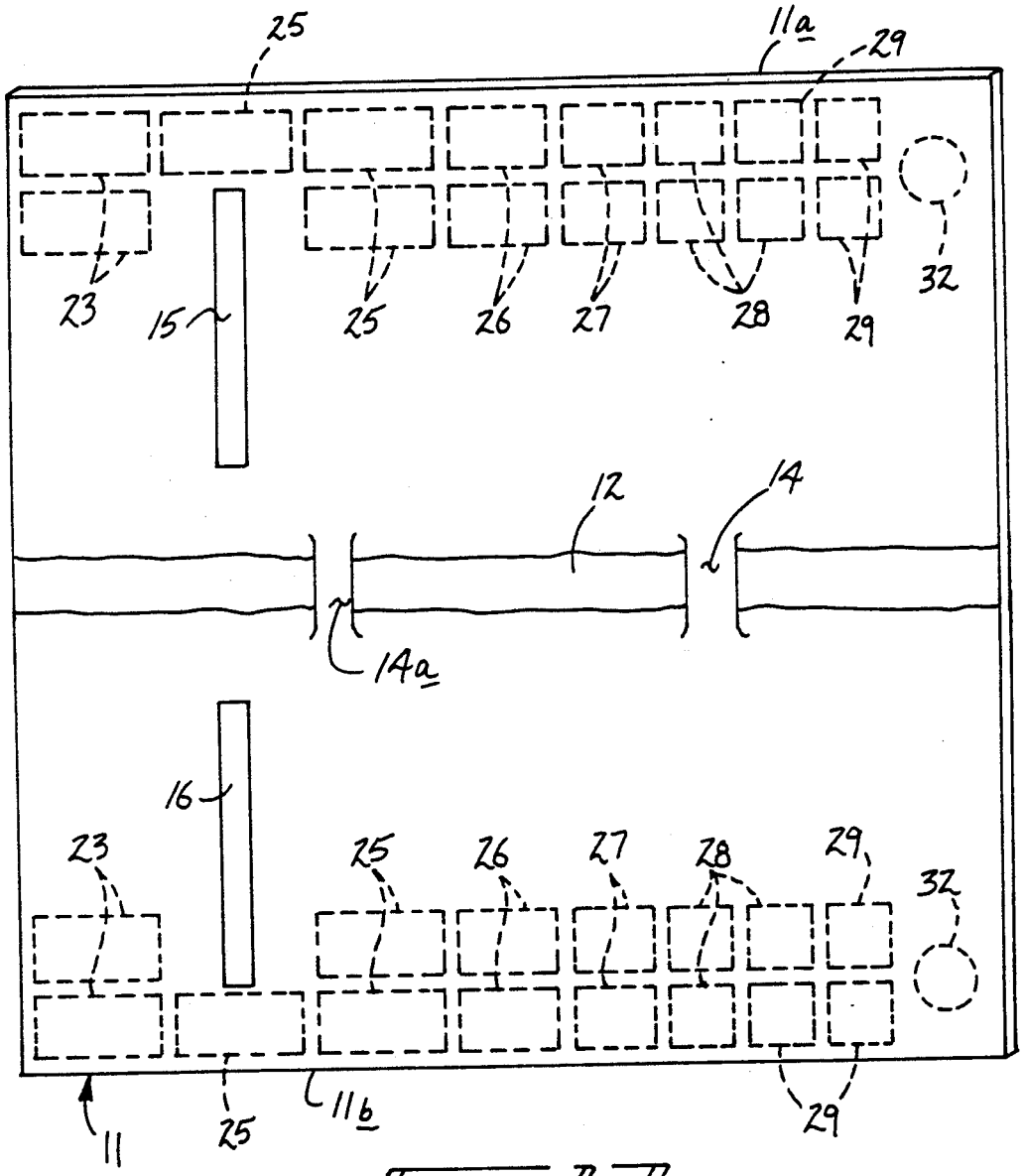
FIG. 12 is a top orthographic view of the game board illustrating a possible initial starting position of a player in a beginning formation.

The markers utilized by opposing players include a series of apertured plates to accommodate 113 apertures in accordance with each side being affored 113 soldiers. Each of the plates accommodates a certain predetermined category of soldier markers 22 with each side being provided with two cavalry plates 23 formed with cavalry apertures 24 to receive within each aperture a soldier marker 22, as illustrated in FIG. 3. The soldier markers 22 are formed in opposing player colorations such as the red and white colorations to designate the opposing top and bottom armies on opposing sides of the central river 12. A series of infantry plates including a first infantry plates 25 comprising ten apertures as the cavalry plate is provided with ten apertures, with a second, third, and fourth infantry 26, 27, and 28 provided with respectively eight, six, and four infantry apertures 28*a* to accommodate a plate 22 therewithin. Three artillery plates 29 are each provided with four artillery apertures 30, and finally a single officer plate 32 of a contrasting circular configuration, as opposed to the rectangular and square configurations of the cavalry, infantry, and artillery plates is provided with a single officer aperture 33 to receive the officer marker 21 of a square parallelepiped configuration with an underlying peg positionable within the plate.

The dice member 34 is a six-sided configuration utilizing a series of colorations to indicate the permitted movement of a player in the course of action that the player is to embark upon. The dice 34 includes three side panels 35 of a first or green coloration to indicate an advance of one by any plate of the player whose turn it is to throw the dice member 34. Likewise, a single side panel 36 of a black coloration indicates a retreat of one inch or 2.5 cm. with the top and bottom side panels of a red or third coloration 37 to indicate a killing of two opponent soldier markers 22. The soldier markers 22 are then replaced by black death plates 31 to provide a full marker at all times, including the soldiers killed and those remaining in action.

It is understood that the players are availed of free travel about the surface of the game board between opposing sides 11*a* and 11*b*. The game board is of an arbitrary dimensional configuration, such as a twelve inch to twenty-four inch rectangular configuration dependent upon open space desired by opposing players. The open spaces of the game board, other than the walls 15 and 16, the bridge 14, and the ford 14*a*, allow the players free travel about the game board with their associated players. From the outset, opposing players are aligned in a plurality of rows adjacent opposing sides 11*a* and 11*b* . Initially, each side is awarded one officer plate marker 32 including a single officer aperture 33, there artillary plates 29, with four artillary marker apertures 30 formed respectively therewithin each marker, four infantry plates 25, each including ten infantry marker apertures 28*a*, two infantry plates 26, including eight infantry marker apertures 28*a* each therewithin, two infantry plates 27, each including six infantry marker apertures therewithin, and three infantry plates 28 including four infantry marker apertures each therewithin, and two cavalry plates 23 including ten apertures 24 therewithin. The plates are capable of continued movement until all of the men on an associated plates are killed or replaced by the death markers 31, as noted, and subsequently that plate is removed from the board of play. Accordingly, when all of the soldiers of an opposing player's army are "killed" that player loses and a winner of the two players is then decided. From the initial positioning of the seventeen plates afforded each player in a plurality of rows adjacent opposing sides 11*a* and 11*b* of the board, the plates are free to attempt crossing of the central river portion 12 via the bridge 14 or the ford 14*a*. Killing soldier markers of a opposing player is permitted only when at least one player's plate crosses the river and moves into the opposing player's side. Then when the player rolls red, two soldier markers on opposing player's plates, which are also on the same side of the board, are killed and removed. The players may utilize the walls 15 or 16 in an effort to seek shelter or plan strategy in an effort to surround or assault opposing plates.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a battle strategy game comprising the steps of, providing a playing board free of movement demarcation, and providing said board with a medially positioned simulated river with a bridge-like crossing over said river; and said river defining two open spaces on either side of said river, said open spaces representing two opposing playing sides, providing a plurality of apertured plates for each player, and providing soldier tokens positionable within said apertured plates, and providing a single dice with three sides of a first coloration, one side of a second coloration, and top and bottom sides of a third coloration, and each player initially placing their said apertured plates on their said respective opposing sides of the board, each player in turn throwing said dice, and when a player'throw results in said first coloration being presented in an upward orientation, said first coloration directing said player to advance one inch or equivalent, advancing said player's plates across said river and into said opposing side of the board, and upon said player's throw resulting in attaining said second coloration, said second coloration directing said player, having at least one plate on said opposing side of the board, to remove two soldier tokens on opposing player's plates which are also on the opposing side of the board, and upon said player attaining said third coloration direction said player to retreat one inch equivalent.

2. A method of playing a battle strategy game as set forth in claim 1 comprising the steps of providing each player with seventeen apertured plates, and forming said apertured plates into four categories, and providing each player with 113 soldier tokens.

3. A method of playing a battle strategy game as set forth in claim 2 further including the step of providing a top figurative wall and a bottom figurative wall within said game board, and wherein said top and bottom figurative walls are orthogonally oriented relative to said central river and terminate at their other ends removed from a border defining said game goard, and wherein each player attempts to advance across said river by directing the apertured plates and associated soldier tokens across said bridge and the ford and around a respective wall to cross the river.

4. A method of playing a battle strategy game as set forth in claim 3 further including the step of aligning the apertured plates of each player on a plurality of rows adjacent a respective player's border of the game board.

5. A method of playing a battle strategy game as set forth in claim 4 wherein a black soldier token is substituted for a soldier token within the apertured plates upon a soldier token being removed by an opposing player upon the opposing player attaining the second coloration of the dice.

* * * * *